US006912932B2

(12) United States Patent
Kriaski et al.

(10) Patent No.: US 6,912,932 B2
(45) **Date of Patent: *Jul. 5, 2005**

(54) DEPTH ADJUSTING SYSTEM FOR A SCREW GUN

(75) Inventors: John Robert Kriaski, Jackson, TN (US); Daniel Paxton Wall, Humboldt, TN (US)

(73) Assignee: Porter-Cable/Delta, Jackson, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/643,893

(22) Filed: Aug. 20, 2003

(65) Prior Publication Data

US 2004/0033111 A1 Feb. 19, 2004

Related U.S. Application Data

(63) Continuation of application No. 09/892,548, filed on Jun. 28, 2001, now Pat. No. 6,758,116.

(51) Int. Cl.[7] ..... B25B 13/00
(52) U.S. Cl. ..... 81/54; 81/429; 173/13
(58) Field of Search ..... 81/52, 54, 429; 173/13

(56) References Cited

U.S. PATENT DOCUMENTS

| | | | |
|---|---|---|---|
| 1,744,976 | A | 1/1930 | Levedahl |
| 1,855,456 | A | 4/1932 | Miller |
| 2,176,928 | A | 10/1939 | Short |
| 2,235,374 | A | 3/1941 | Kellogg |
| 2,430,044 | A | 11/1947 | Campsmith |
| 2,475,518 | A | 7/1949 | Ristow |
| 2,564,345 | A | 8/1951 | Shaff |
| 2,570,164 | A | 10/1951 | Shaff |
| 2,658,538 | A | 11/1953 | Kitterman |
| 2,743,636 | A | 5/1956 | Shaff |
| 2,790,471 | A | 4/1957 | Graybill |
| 2,840,126 | A | 6/1958 | Schmitt |
| 2,857,997 | A | 10/1958 | Graybill |

(Continued)

FOREIGN PATENT DOCUMENTS

| | | |
|---|---|---|
| DE | 1 981 300 | 3/1968 |
| DE | 33 08 135 A1 | 9/1984 |
| DE | 33 42 880 A1 | 6/1985 |
| DE | 34 31 630 A1 | 3/1986 |
| DE | 43 10 624 A1 | 10/1993 |
| WO | WO 92/15428 | 9/1992 |

OTHER PUBLICATIONS

Hitachi Model No. W6VE Screwdriver Parts List, Nov. 8, 1984, 6 pages.
Hitachi Model No. W6V Screwdriver Parts List, Jan. 1989, 2 pages.
Hitachi Model No. W5DB Cordless Drywall Screwdriver Parts List, Apr. 30, 1988, 6 pages.
Hitachi Model No. W6VF Screwdriver Parts List, Nov. 8, 1984, 6 pages.

(Continued)

*Primary Examiner*—James G. Smith
(74) *Attorney, Agent, or Firm*—Hunton & Williams

(57) ABSTRACT

A depth adjusting system for a screw gun comprises a base supported on the screw gun, an on/off collar removably attached to the base, and an adjusting collar and a depth locator mounted to the on/off collar. The adjusting collar rotates but cannot move axially relative to the on/off collar. Rotation of the adjusting collar causes the depth locator to move axially relative to the on/off collar for adjusting the depth setting. An indexing system is provided between the adjusting collar and the on/off collar for retaining the angular position of the adjusting collar and the depth setting. The on/off collar can be easily attached and detached from the base with a simple axial force applied to the on/off collar.

3 Claims, 6 Drawing Sheets

U.S. PATENT DOCUMENTS

| | | | |
|---|---|---|---|
| 2,940,488 | A | 6/1960 | Riley, Jr. |
| 3,146,811 | A | 9/1964 | Shryock |
| 3,187,865 | A | 6/1965 | Blachowski |
| 3,289,715 | A | 12/1966 | De Groff |
| 3,298,410 | A | 1/1967 | Morifuji |
| 3,454,059 | A | 7/1969 | Sindelar |
| 3,460,408 | A | 8/1969 | Raymond |
| 3,477,521 | A | 11/1969 | Kiester |
| 3,527,273 | A | 9/1970 | Falter |
| 3,601,168 | A | 8/1971 | Harry |
| 3,616,883 | A | 11/1971 | Sindelar |
| 3,710,832 | A | 1/1973 | Lafferty, Sr. |
| 3,712,352 | A | 1/1973 | Lafferty, Sr. |
| 3,800,839 | A | 4/1974 | Bogle |
| 3,834,252 | A | 9/1974 | Abell et al. |
| 3,869,942 | A | 3/1975 | DeCaro |
| 3,934,629 | A | 1/1976 | Boman |
| 3,943,800 | A | 3/1976 | Lesner |
| 4,030,383 | A | 6/1977 | Wagner |
| 4,037,982 | A | 7/1977 | Clement |
| 4,154,308 | A | 5/1979 | Goldsberry |
| 4,159,050 | A | 6/1979 | Hopkins, Sr. |
| 4,237,946 | A | 12/1980 | Leitner |
| 4,592,257 | A | 6/1986 | Diirr |
| 4,617,843 | A | 10/1986 | Nishida |
| 4,625,597 | A | 12/1986 | Cast |
| 4,630,512 | A | 12/1986 | Diirr |
| 4,647,260 | A | 3/1987 | O'Hara et al. |
| 4,655,103 | A | 4/1987 | Schreiber et al. |
| 4,712,456 | A | 12/1987 | Yuan |
| 4,756,216 | A | 7/1988 | Lo |
| 4,762,035 | A | 8/1988 | Fushiya et al. |
| 4,764,060 | A | 8/1988 | Khurana |
| 4,766,783 | A | 8/1988 | Stanich |
| 4,803,904 | A | 2/1989 | Stanich |
| 4,809,572 | A | 3/1989 | Sasaki |
| 4,913,242 | A | 4/1990 | Lo |
| 4,947,714 | A | 8/1990 | Fluri |
| 5,025,903 | A | 6/1991 | Elligson |
| 5,044,233 | A | 9/1991 | Tatsu et al. |
| 5,060,733 | A | 10/1991 | Kress |
| 5,094,133 | A | 3/1992 | Schreiber |
| 5,096,342 | A | 3/1992 | Blankenship |
| 5,134,909 | A | 8/1992 | Sasaki |
| 5,138,916 | A | 8/1992 | Sato et al. |
| 5,182,973 | A | 2/1993 | Martindell |
| 5,209,308 | A | 5/1993 | Sasaki |
| 5,271,471 | A | 12/1993 | Sasaki |
| 5,341,704 | A | 8/1994 | Klemm |
| 5,341,708 | A | 8/1994 | Nick |
| 5,350,026 | A | 9/1994 | Markus et al. |
| 5,360,073 | A | 11/1994 | Akazawa |
| 5,372,206 | A | 12/1994 | Sasaki et al. |
| 5,380,132 | A | 1/1995 | Parks |
| 5,509,330 | A | 4/1996 | Nick |
| 5,524,512 | A | 6/1996 | Wolfe |
| 5,538,089 | A | 7/1996 | Sanford |
| 5,557,990 | A | 9/1996 | Shin |
| 5,568,849 | A | 10/1996 | Sasaki et al. |
| 5,601,387 | A | 2/1997 | Sanford et al. |
| 5,651,489 | A | 7/1997 | Janssen |
| 5,673,758 | A | 10/1997 | Sasaki |
| 5,682,800 | A | 11/1997 | Jore |
| 5,709,275 | A | 1/1998 | Neumaier |
| 5,735,183 | A | 4/1998 | Sasaki |
| 5,775,186 | A | 7/1998 | Rahm |
| 5,778,989 | A | 7/1998 | Neumaier |
| 5,865,076 | A | 2/1999 | Fujiyama et al. |
| 5,881,613 | A | 3/1999 | Han |
| 5,947,210 | A | 9/1999 | Sasaki et al. |
| 6,050,157 | A | 4/2000 | Ludwig |
| 6,105,450 | A | 8/2000 | Sasaki et al. |
| 6,109,149 | A | 8/2000 | Neumaier |
| 6,173,792 | B1 | 1/2001 | Hald |
| 6,176,162 | B1 | 1/2001 | Ludwig et al. |
| 6,240,816 | B1 | 6/2001 | Riedl et al. |
| 6,499,381 | B2 | 12/2002 | Ladish et al. |
| 6,536,537 | B1 | 3/2003 | Sasaki et al. |
| 6,547,013 | B2 | 4/2003 | Riedl et al. |

OTHER PUBLICATIONS

Hitachi Model No. W6V2 Screwdriver Parts List, May 31, 1993, 3 pages.

Hitachi Model No. W6VA Screwdriver Parts List, Jan. 1989, 2 pages.

Hitachi Model No. W6VA1 Screwdriver Parts List, Dec. 21, 1990, 4 pages.

Hitachi Model No. W6VA2 Screwdriver Parts List, May 31, 1993, 3 pages.

Hitachi Model No. W6VB Screwdriver Parts List, Dec. 10, 1996, 4 pages.

Hitachi Model No. W6, W6SA Screwdriver Parts List, Jan., 1989, 1 page.

Bosch Model No. 1423VSR Fastener Driver Parts List, Oct., 1997, 2 pages.

Bosch Model No. 1423VSRQ Fastener Driver Parts List, Oct., 1997, 3 pages.

Bosch Model No. 1422VSR Fastener Driver Parts List, Oct., 1997, 3 pages.

Bosch Model No. 1421VSR Drywall Driver Parts List, Oct., 1997, 3 pages.

Bosch Model No. 1420VSR Drywall Driver Parts List, Oct., 1997, 3 pages.

Bosch Model No. 1405VSR Drywall Driver Parts List, Oct., 1997, 3 pages.

Bosch Model No. 1404VSR Drywall Driver Parts List, Oct., 1997, 3 pages.

DEPTH ADJUSTING SYSTEM FOR A SCREW GUN

This application is a continuation of U.S. patent application Ser. No. 09/892,548 filed Jun. 28, 2001 (now U.S. Pat. No. 6,758,116, issued Jul. 6, 2004).

BACKGROUND OF THE INVENTION

1. Field of the Invention

The field of this invention is depth adjusting systems for power tools. More particularly the field is depth adjusting systems for screw guns in which part of the system is easily removable from the screw gun to gain access to the spindle and screwdriving bit, and the system retains its depth setting when it is replaced on the screw gun.

2. Description of Related Art

U.S. Pat. No. 4,647,260 to O'Hara et al. and U.S. Pat. No. 5,341,704 to Klemm disclose depth adjusting systems for screw guns.

The O'Hara et al. patent discloses a two piece depth adjusting system comprising an adjustment collar (26, FIG. 2) and a depth locator (28). The adjustment collar releasably attaches to the nose portion (24) of the screw gun. The depth locator (28) engages the adjustment collar (26) through a screw thread arrangement. When attached to the nose portion (24), the adjustment collar (26) is rotated to adjust the axial position of the depth locator (28). The depth locator (28) is prevented from rotating relative to the nose portion (24) so that when the adjustment collar (26) rotates, the depth locator (28) is in turn driven axially through the screw thread arrangement. Indexing means are also provided between the nose portion (24) and the adjusting collar (26) to retain the adjusting collar (26) in a predetermined angular position relative to the nose portion (24) and thus also retain the depth setting of the depth locator (28). However, when the adjusting collar (26) is removed from the nose portion (24), the indexing means no longer retains the angular position of the adjusting collar (26). When a user removes the adjusting collar (26) and the depth locator (28) to, for example, change the screwdriving bit, the depth setting may be lost and will have to be reset when the adjusting collar (26) and depth locator (28) are replaced on the screw gun.

The Klemm patent discloses a two piece depth adjusting system comprising a sleeve (94, FIG. 7) and a depth locator (76). The sleeve (94) is releasably attached to the gear case of the tool. A groove (40, FIG. 2) on the gear case holds a resilient split retaining ring (42). A flange (98) on the sleeve (94) engages and moves over the retaining ring (42) with an audible snap when sleeve (94) is attached to the gear case. The sleeve (94) may be detached by pulling it axially away from the gear case. In the commercial embodiment of the Klemm patent, the force required to detach the sleeve (94) varies and is sometimes excessive when the flange (98) "hangs up" on the retaining ring (42).

Once attached, the sleeve (94) does not rotate or move axially relative to the tool. The depth locator (76) engages the sleeve (94) through a screw thread arrangement. Rotation of the depth locator (76) by the user causes the depth locator (76) to be driven axially by the screw thread arrangement to adjust the depth setting. An indexing means between the sleeve (94) and the depth locator (76) retains the angular position of the depth locator (76) relative to the sleeve (94) and thus maintains the depth setting. Although the indexing means functions regardless of whether the sleeve (94) is attached to the gear case, in order to adjust the depth locator (76), the user must manually turn the depth locator (76) itself. This can be awkward because the radius of the depth locator (76) is relatively small so that turning the locator (76) is not ergonomically comfortable.

SUMMARY OF THE INVENTION

It is an object of the invention to overcome these and other drawbacks found in the prior art depth adjusting systems and to provide additional advantageous features.

In one embodiment, a depth adjusting system for removably attaching to a base of a tool comprises an on/off collar removably attachable to the base so that the on/off collar is not rotatable relative to the base when it is attached thereto, an adjusting collar mounted to the on/off collar and being rotatably but not axially moveable relative to the on/off collar, and a depth locator mounted to the on/off collar and being rotatably and axially moveable relative to the on/off collar such that the depth locator moves axially in response to relative rotation between the depth locator and the on/off collar. The depth setting of the depth adjusting system can be adjusted by rotating the adjusting collar which in turn drives the depth locator to rotate in unison, such rotation causing axial movement of the depth locator.

In another embodiment, a depth adjusting system for a screw gun comprises a spindle extending from the screw gun and adapted to receive a screwdriving bit mounted on one end of the spindle for driving a screw into a workpiece, and a removable depth adjusting assembly removably attached to the screw gun. The removable depth adjusting assembly has a central opening therethrough at least partially surrounding the spindle, the opening defining an axis parallel to the rotational axis of the spindle. The removable depth adjusting assembly comprises an adjusting collar rotatably but not axially moveable relative to the screw gun when the removable depth adjusting assembly is releasably mounted to the screw gun, a depth locator operatively associated with the adjusting collar wherein the depth locator moves axially to adjust a depth setting responsive to rotation of the adjusting collar relative to the screw gun, and an indexing means for releasably retaining the adjusting collar in its selected angular position regardless of whether the removable depth adjusting assembly is attached to the screw gun. The indexing means can be overcome to rotate the adjusting collar by a deliberate torque applied to the adjusting collar by a user.

In another embodiment, a depth adjusting system for a tool comprises a base having receiving means, and a removable depth adjusting assembly removably attached to the base. The removable depth adjusting assembly comprises a depth locator whose axial position relative to the base is adjustable while the removable depth stop is attached to the base, and a first collar connected to the depth locator having at least two tabs projecting therefrom which engage with the receiving means when the removable depth adjusting assembly is attached to the base. The tabs have rounded profiles wherein an axial force applied to the collar can engage and disengage the tabs with the receiving means.

In another embodiment, a method for adjusting the depth setting of a depth adjusting system for a screw gun, the method comprises the steps of: rotating an adjustment collar and prohibiting the axial movement of the adjustment collar, causing a depth locator to rotate in response to the rotation of the adjustment collar, and causing the depth locator to move axially in response to its rotational movement, the axial movement of the depth locator effecting an adjustment of the depth setting.

DETAILED DESCRIPTION OF THE PREFERRED EMBODIMENTS

The depth adjusting system of the present invention is especially useful in screw guns with a depth sensitive clutch to control the depth to which the head of a screw will be driven into a work piece. The depth adjusting system will be described in relation to its use in this preferred context. However, the depth adjusting system is not limited to use with a screw gun and may also find use in other tools.

Screw guns with depth sensitive clutches are well known in the art (see, e.g., U.S. Pat. Nos. 4,655,103 and 4,947,714). A co-pending application assigned to the same assignee as this application also discloses a depth sensitive clutch and its operation in detail. This co-pending application Ser. No. 09/923,434 is hereby incorporated by reference in its entirety into this specification.

Figure 1:
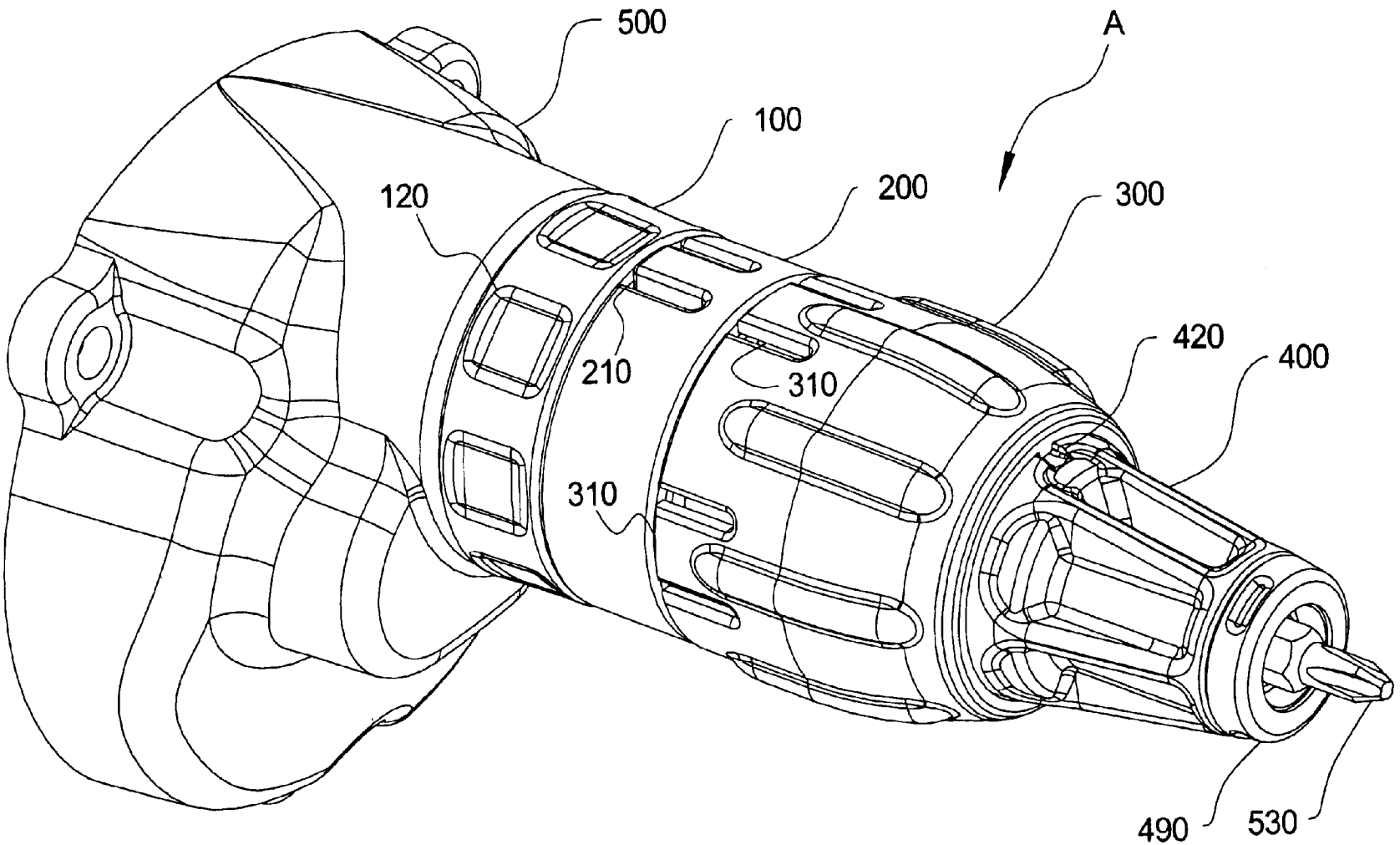
FIG. 1 is an isometric view of one embodiment of the depth adjusting system along with a front portion of the housing of a screw gun.

As shown in FIG. 1, the depth adjusting system comprises a base 100, an on/off collar 200, an adjusting collar 300, and a depth locator 400. As will be described in further detail herein, the base 100 is mounted to the housing 500 of the screw gun. The on/off collar 200, adjusting collar 300, and depth locator 400 remain assembled one to another during normal use and will be referred to herein as the removable depth adjusting assembly A, or simply removable assembly A. The removable depth adjusting assembly A is releasably attached to the base 100. The removable assembly A has a central opening therethrough and partially encloses a spindle 520 and screwdriving bit 530. The spindle 520 and screwdriving bit 530 rotate to drive a screw into a work piece. When a wear surface 490 on the forward end of the depth locator 400 contacts the work piece, the depth sensitive clutch begins to disengage and the driving of the screw will stop upon complete disengagement. Thus, the axial position of the depth locator 400 determines the depth to which the screw will be driven.

A simple axial force applied to the removable depth adjusting assembly A in the direction of its longitudinal axis will reliably attach and detach it from base 100. The longitudinal axis of the removable depth adjusting assembly A is coaxial with, or at least parallel with, the axis of rotation of the spindle 520 and the screwdriving bit 530.

When the on/off collar 200 is attached to the base 100, it is prevented from rotating. (In this application, when it is stated that one part does not move relative to another part, this means that the parts may still experience slight relative motion due to design and manufacturing tolerances.) The adjusting collar 300 can be rotated but cannot be moved axially relative to the screw gun. Rotation of the adjusting collar 300 by the user causes the depth locator 400 to rotate in unison. The depth locator 400 moves axially relative to the screw gun to adjust the depth setting of the depth adjusting system in response to relative rotation between the depth locator 400 and the screw gun.

An indexing means retains the adjusting collar 300 in its angular position, thus also retaining the axial position of the depth locator 400 and the depth setting of the depth adjusting system. Advantageously, the indexing means retains the depth setting even when the removable assembly A is not attached to the base 100.

Figure 2:
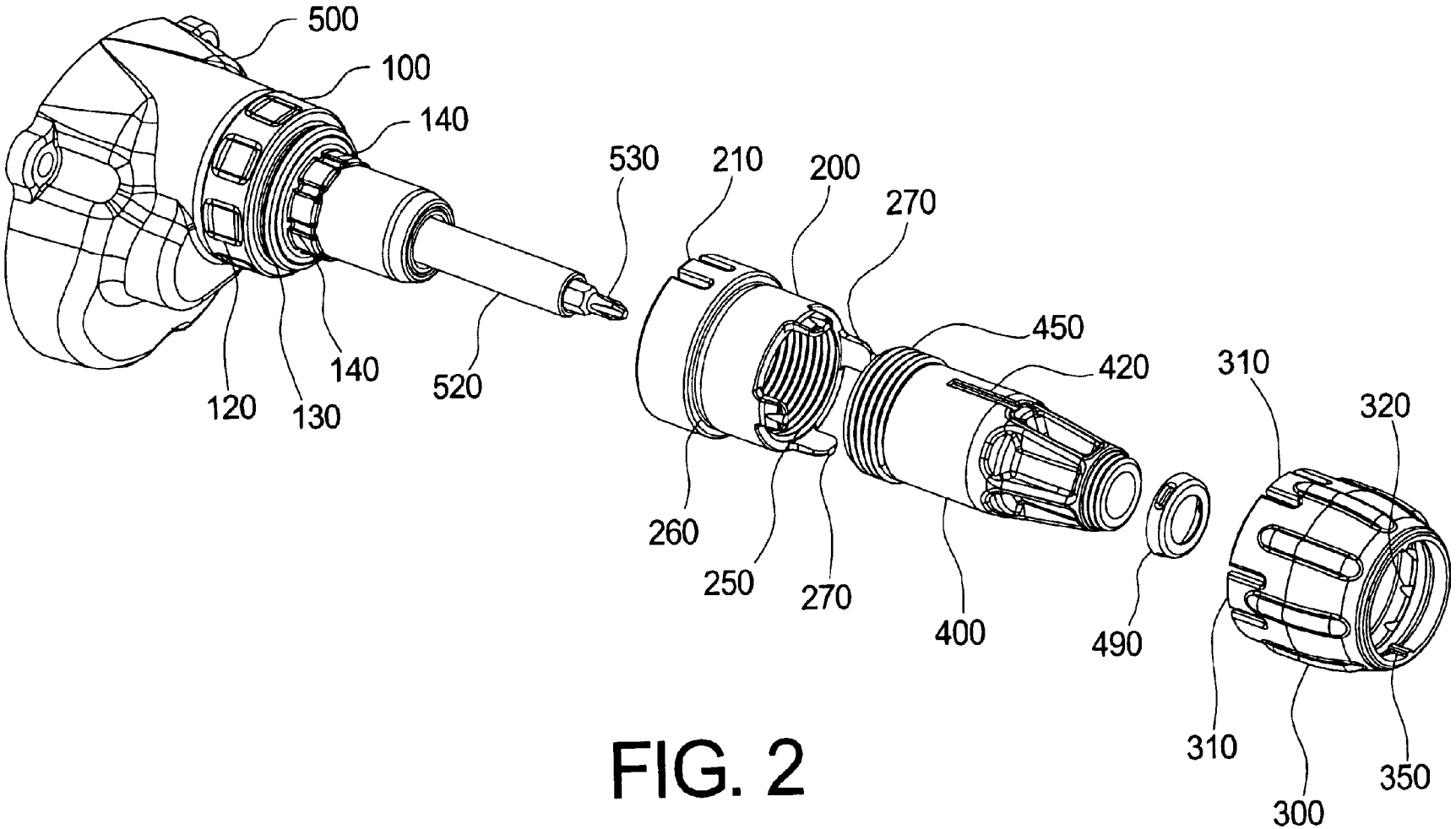
FIG. 2 is an exploded view of the depth adjusting system of FIG. 1.
Figures 3, 4:
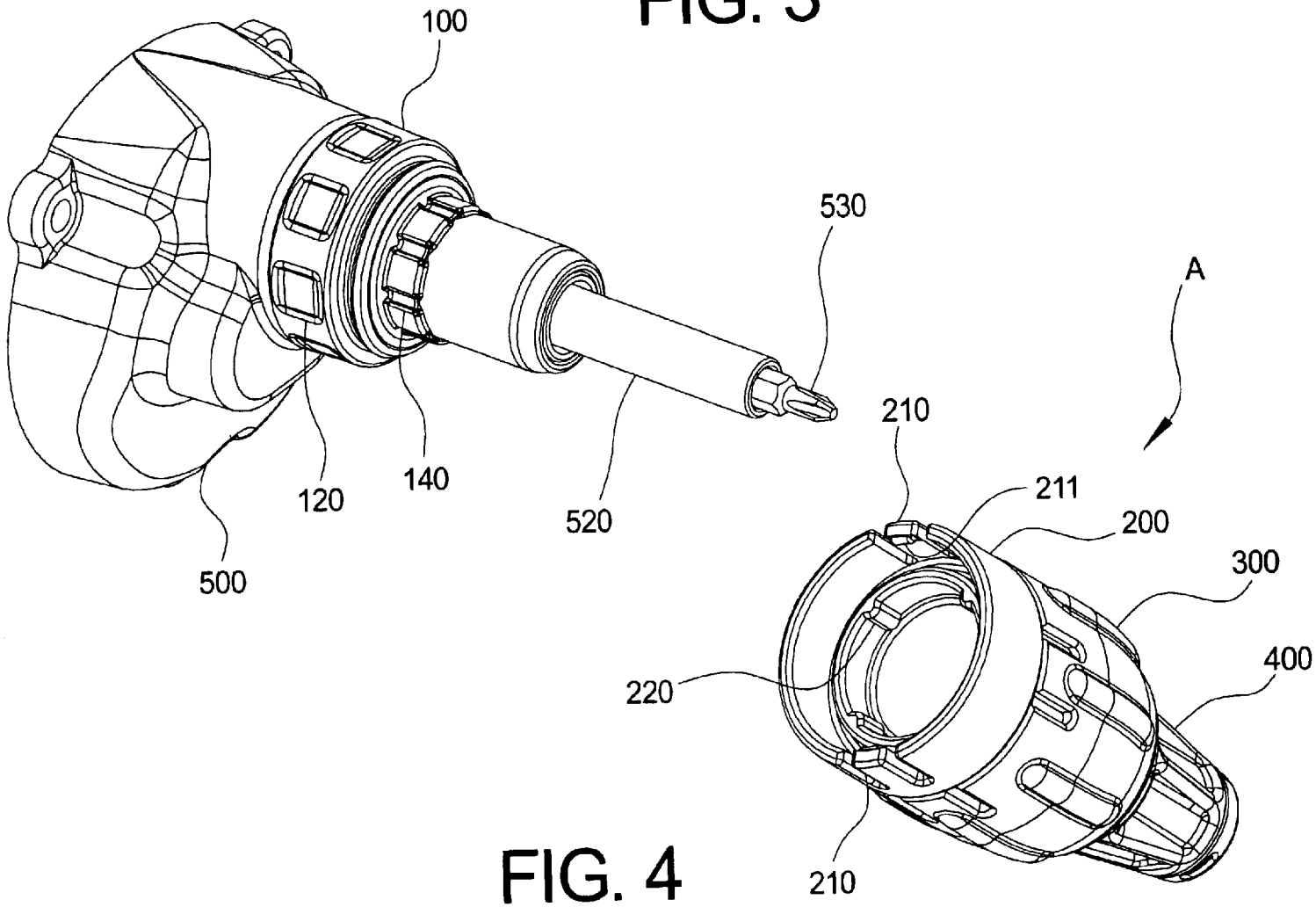
FIGS. 3 and 4 are isometric views of the depth adjusting system of FIG. 1 with the removable depth adjusting assembly detached from the screw gun.
Figure 8:
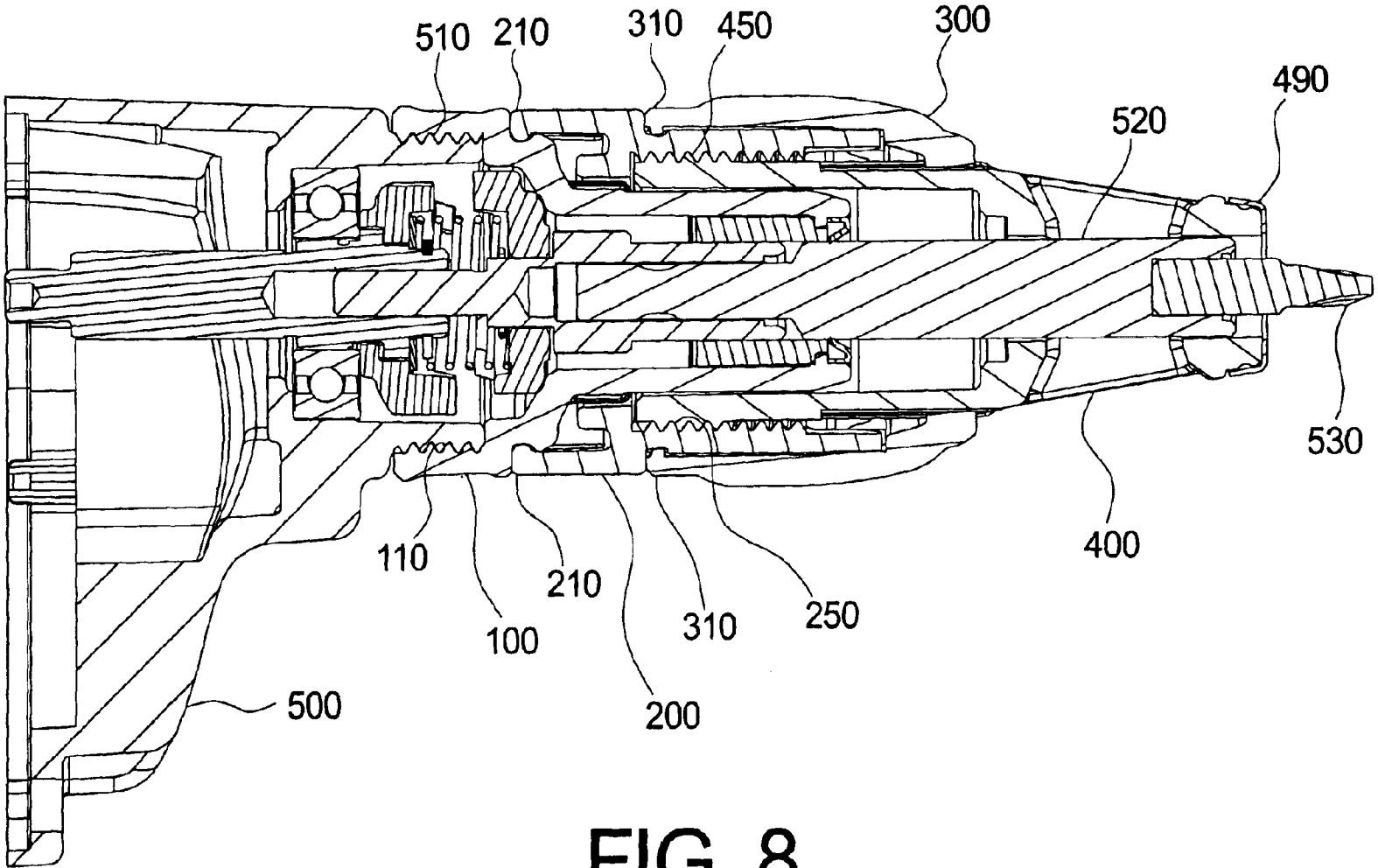
FIG. 8 is a sectional view of the depth adjust system of FIG. 1 taken along the longitudinal axis thereof.

With reference now to FIGS. 2 and 8, the base 100 is mounted to the housing 500 of the screw gun and provides an attachment structure for releasably attaching the on/off collar 200 to the screw gun. In a preferred embodiment, the base 100 has threads 110 (FIG. 8) formed on an end thereof which engage with complementary threads 510 (FIG. 8) formed on the housing. Other mounting systems may also be used. When the depth adjusting system is used with a screw gun having a depth sensitive clutch, the base 100 may enclose a portion of the clutch assembly and even cooperate with support structure, such as bearings or seals, for the clutch assembly, as shown in FIG. 8. In such a situation, it is advantageous to removably mount the base 100 to the housing 500 with a system such as threads 110, 510 which permit the user to remove the base 100 from the housing 500 when it is desired, for example, to service the clutch components. Base 100 has gripping elements 120 formed around an exterior periphery to help remove base 100 from housing 500. The threads 110, 510 should also reliably prevent the base 100 from coming loose from the housing 500 during normal use. Other mounting systems for mounting the base 100 to the housing 500 may also be used and will be within the scope of the invention. Also, if it is unnecessary for the base 100 to be removable, the base 100 may be integrally formed with the housing 500 as part of a unitary component.

With reference to FIGS. 2–6, the on/off collar 200 is removably attachable to the base 100, and thus through association the entire removable depth adjusting assembly A is removably attachable to the base 100. Removably attachable and removably attached mean that the when the removable assembly A is attached to the base 100, it resists detachment with a retention force, and the retention force can be easily overcome or released by the user to purposefully detach the removable assembly A. A feature of one embodiment is that the removable assembly A can be simply and reliably attached and detached from the base 100 by applying an axial force on the removable assembly A toward or away from the base 100.

To this end, the on/off collar 200 may be provided with resilient hinges 210, each with rounded tab portions 211 projecting inwardly from the surface thereof toward the longitudinal axis of the removable assembly A. The resilient hinges 210 may flex radially outwardly or inwardly from the longitudinal axis of the assembly A. The base 100 may have receiving means for receiving the tab portions 211. The receiving means may be a circumferential groove 130, or a circumferential array of detents for receiving the tab portions 211 therein, or any other appropriate structure for receiving the tab portions 211 therein.

Figure 5:
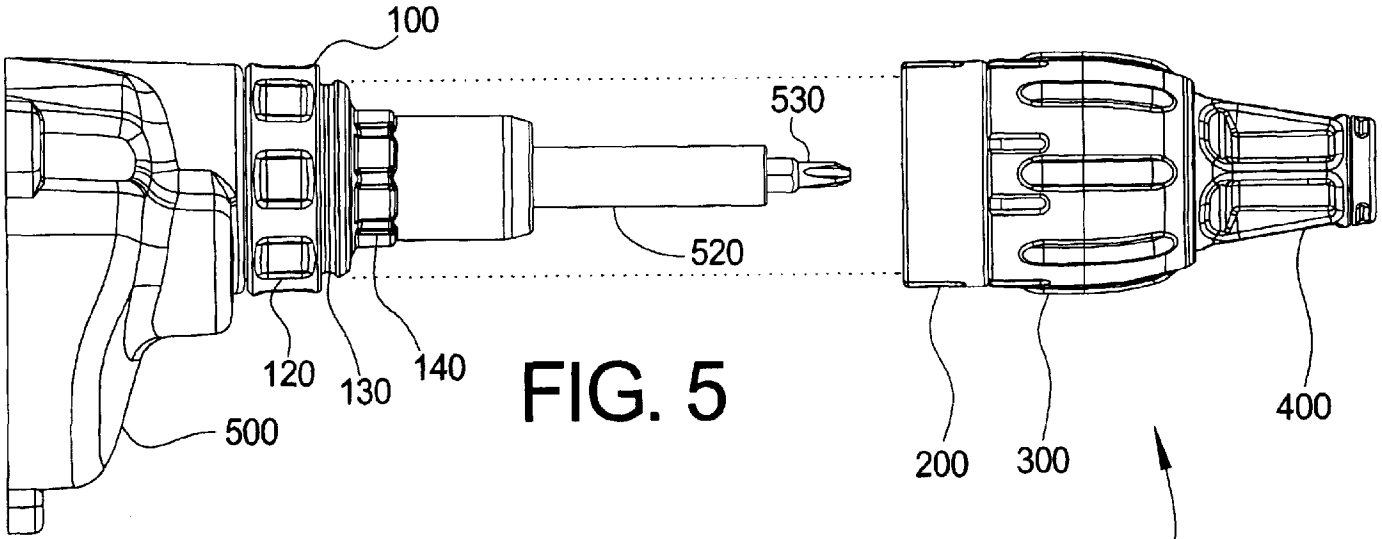
FIGS. 5 and 6 are side views of the depth adjusting system of FIG. 1 illustrating the attachment of the removable depth adjusting assembly to the screw gun.
Figure 6:
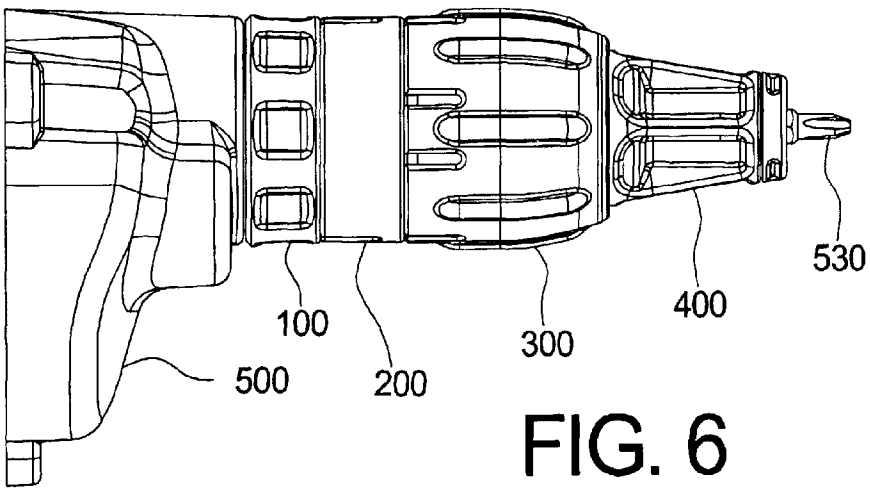

As seen in FIG. 5, when the on/off collar 200 is being attached to the base 100, the resilient hinges 210 must flex outwardly while the tab portions 211 slide over a larger diameter portion of base 100 and into the groove 130. Because the resilient hinges 210 must flex outwardly before the on/off collar 200 can be removed from the base 100 and due to the rounded profile of tab portions 211, a retention force is created resisting detachment of the on/off collar 200 from the base 100. However, also due to the rounded profile of tab portions 211, the retention force can be overcome by a deliberate axial pulling force from the user to detach the on/off collar 200 from the base 100.

Other arrangements for releasably attaching the on/off collar 200 to the base 100 may be used. For example, a retaining ring may be provided on one of the base 100 and an internal flange on the on/off collar 200. Or the on/off collar 200 and the base 100 may be provided with complementary threads. However, the arrangement illustrated herein is preferred because the pulling force necessary to detach the on/off collar 200 from the base 100 is more reliably consistent than with a retaining ring design. Due partly to their rounded profile, tab portions 211 do not "hang up" on the base 100 as a flange may do on a retaining ring. Also, the resilient hinges 210 and groove 130 may be sized so that the resilient hinges 210 are biased outwardly and the tab portions 211 are constantly exerting an inward force on the groove 130 when the on/off collar 200 is attached to the base 100. This positive engagement tends to prevent the on/off collar 200 from feeling "loose" or "sloppy" when it is mounted on the base 100.

When the on/off collar 200 is mounted to the base 100, it is prevented from rotating relative to the base 100. With reference to FIGS. 2–6, in a preferred embodiment base 100 has detents 140 radially evenly spaced around the circumference of at least a portion thereof. The on/off collar 200 has locking tabs 220 radially evenly spaced around at least a portion of an internal surface thereof. Locking tabs 220 align with and engage at least some of the detents 140 when the on/off collar 200 is mounted to the base 100. The locking tabs 220 and detents 140 have an approximately semi-cylindrical cross-section in the illustrated embodiment, but any appropriate shape could be used. In the illustrated embodiment, eight detents 140 are provided so that there are eight positions in which the on/off collar 200 can removably attach onto the base 100. This advantageously reduces the need to hunt for the correct orientation when attaching the on/off collar 200 to the base 100. Other methods of preventing the relative rotation of the on/off collar 200 and the base 100 may be used.

Figure 7:
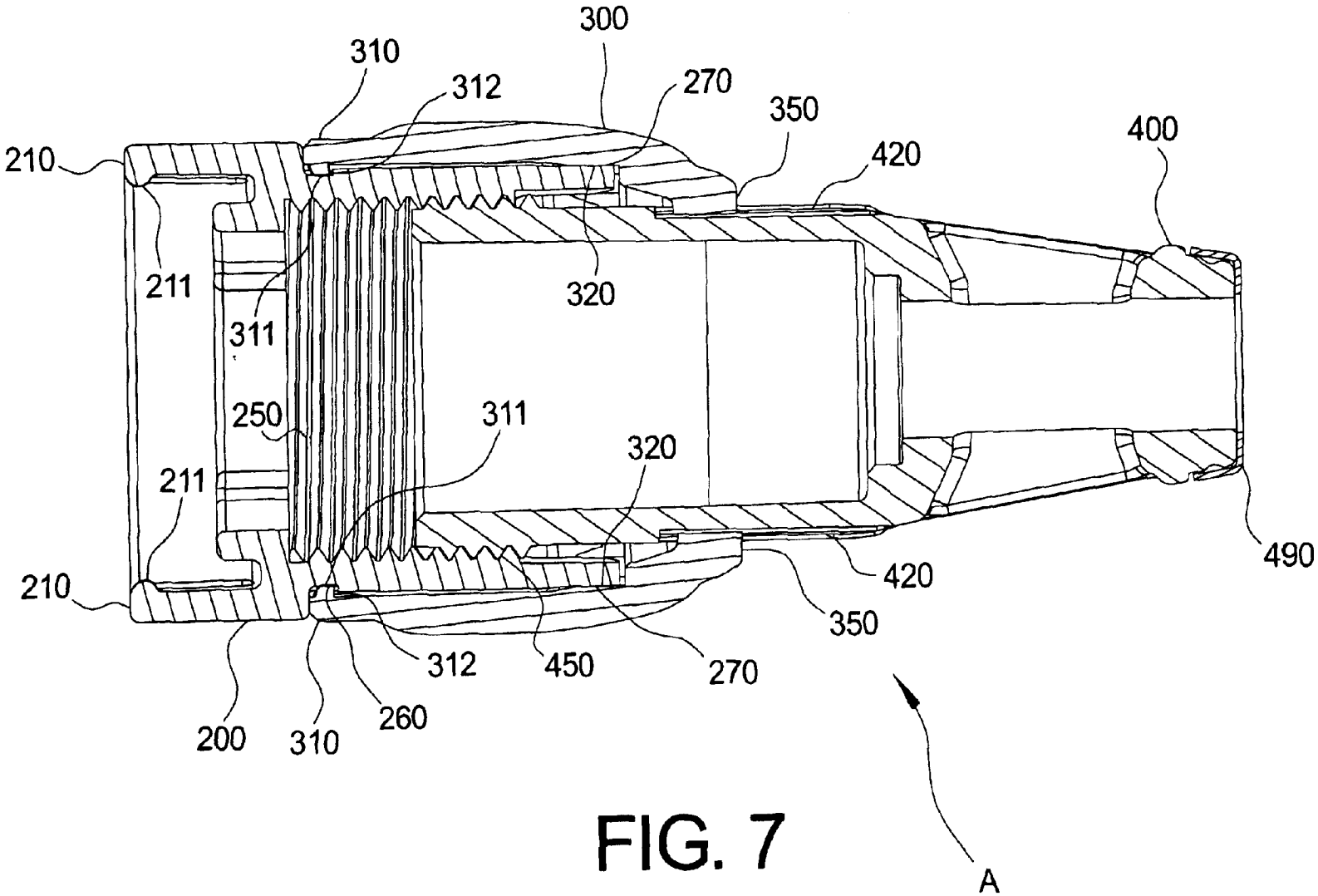
FIG. 7 is a sectional view of the removable depth adjusting assembly of the depth adjusting system of FIG. 1 taken along the longitudinal axis thereof.

The depth locator 400 is mounted to the on/off collar 200 in such a way that relative rotation causes the depth locator 400 to move axially away from or toward the on/off collar 200 to adjust the depth setting. With reference now to FIGS. 2 and 7, in a preferred embodiment threads 250 are formed on an interior portion of the on/off collar 200 and complementary threads 450 are formed on an exterior portion of the depth locator 400. This arrangement is advantageous because rotating the depth locator 400 relative to the on/off collar 200 causes a relatively small amount of axial movement, dependent upon the pitch of the threads 250, 450. Thus, fine adjusting of the depth setting is possible.

Adjusting collar 300 is rotatably mounted to the on/off collar 200, but is not axially moveable relative to the on/off collar 200. With reference again to FIGS. 2 and 7, in a preferred embodiment adjusting collar 300 may be provided with resilient hinges 310, each with locking tabs 311 projecting inwardly from the surface thereof toward the longitudinal axis of the removable assembly A. The resilient hinges 310 are flexible radially outwardly or inwardly from the longitudinal axis of the assembly A. A circumferential groove 260 may be formed on the on/off collar 200 for receiving the locking tabs 311 therein. When the adjusting collar 300 is being mounted to the on/off collar 200, the resilient hinges 310 must flex outwardly while the locking tabs 311 slide over a large diameter portion of the on/off collar 200 and then snap into groove 260. Locking tabs 311 each have a locking surface 312 formed at a right angle to the longitudinal axis of the removable assembly A, and the sides of groove 260 are also formed at a right angle to the longitudinal axis of the removable assembly A. Due to this construction, once the locking tabs 311 snap into groove 260, they cannot easily be removed so that the adjusting collar 300 is held axially relative to the on/off collar 200 (but is free to rotate). Alternatively, the adjusting collar 300 may be detachably mounted to the on/off collar 200, if desired. Other systems for preventing axial movement but allowing rotational movement of the adjusting collar 300 relative to the on/off collar 200 may be used within the scope of the invention.

Adjusting collar 300 engages the depth locator 400 so that they rotate in unison. With reference again to FIGS. 2 and 7, in a preferred embodiment the adjusting collar 300 has at least one driving key 350 extending radially inwardly from the surface thereof. The depth locator 400 has at least one elongated slot 420 formed on the exterior thereof. When the adjustment assembly A is assembled, the driving key 350 is received in the slot 420. When the adjusting collar 300 is rotated (and the on/off collar 200 remains stationary), the driving key 350 pushes against the side of the slot 420 and drives the depth locator 400 to rotate in unison. When the depth locator 400 rotates relative to the on/off collar 200 it moves axially relative to the on/off collar 200 and the adjusting collar 300. Slot 420 is elongated to allow the driving key 350 to move from end-to-end in the slot 420. Other systems for allowing relative axial movement but for preventing relative rotational movement between the adjusting collar 300 and the depth locator 400 may be used, as desired.

An indexing means may be provided to retain the depth setting of the depth locator 400. The purpose of the indexing means is to prevent the accidental loss of the depth setting. The indexing means will be overcome if the user purposefully adjusts the depth setting. In a preferred embodiment, the indexing means is provided between the adjusting collar 300 and the on/off collar 200 and retains the angular setting of the adjusting collar 300 relative to the on/off collar 200, even when the adjusting assembly A is not mounted to the base 100. The indexing means may alternatively be provided between the depth locator 400 and the on/off collar 200. The indexing means could even conceivably be located between the adjusting collar 300 and the depth locator 400, in which case the indexing means would retain the axial position of the depth locator 400 relative to the adjusting collar 300.

With reference to FIG. 2, in a preferred embodiment the adjusting collar 300 may have detents 320 radially evenly spaced on an interior surface thereof. The on/off collar 200 may have resilient indexing tabs 270 radially formed on an exterior surface thereof which engage with the detents 320 when the adjusting collar 300 is mounted to the on/off collar 200. When the adjusting collar 300 is rotated relative to the on/off collar 200, the resilient indexing tabs 270 must flex in order to move in and out of the radially spaced detents 320 as the rotation occurs. The force required to flex the indexing tabs 270 is provided by torque applied to the adjusting collar 300. Thus, the retaining action of the indexing means is overcome when the user applies a torque to the adjusting collar 300 great enough to flex the indexing tabs 270 and rotate the adjusting collar 300. Other forms of indexing means may be used. For example, any structure which restricts the movement of one part relative to another part unless a minimum force is applied to flex a portion of one of the parts is one type of indexing means and may be used within the scope of the invention.

It would be possible to encompass the major features of the invention in a depth adjusting system which lacks a separate on/off collar 200. Such a depth adjusting system would comprise merely an adjusting collar 300 and depth locator 400. The adjusting collar would be releasably attached to the base 100 in a manner permitting rotational movement but preventing axial movement relative thereto through, e.g., hinge portions and rounded tab portions engaging a circumferential groove in the base 100. The depth locator 400 would engage with the base 100 in a manner permitting axial movement, but preventing rotational movement relative thereto. The indexing means would in this case be constructed between the adjusting collar 300 and the depth locator 400.

Although this invention has been described in relation to various preferred embodiments, it is not limited to those preferred embodiments. The invention is only limited by the scope of the appended claims. Insubstantial variations of the basic concepts of the invention will be readily apparent to those of skill in this art and will be considered equivalents protected hereby.

We claim:

1. A depth adjusting system for a tool comprising:

a tool housing;

a base releasably attached to the tool housing;

an on/off collar removably attachable to the base so that the on/off collar is not rotatable relative to the base when it is attached thereto;

an adjusting collar mounted to the on/off collar and being rotatably but not axially moveable relative to the on/off collar;

a depth locator mounted to the on/off collar and being rotatably and axially moveable relative to the on/off collar, the axial movement of the depth locator occurring in proportion to and in response to the relative rotation between the depth locator and the on/off collar, the depth locator establising a depth setting of the depth adjusting system; and complementary threads formed on an exterior surface of the depth locator and on an interior surface of the on/off collar for mounting the depth locator to the on/off collar, wherein the depth setting of the depth adjusting system can be adjusted by rotating the adjusting collar which in turn drives the depth locator to rotate in unison, such rotation causing axial movement of the depth locator.

2. A depth adjusting system for a tool comprising:

a tool housing;

a base releasably attached to the tool housing;

an on/off collar removably attachable to the base so that the on/off collar is not rotatable relative to the base when it is attached thereto;

an adjusting collar mounted to the on/off collar and being rotatably but not axially moveable relative to the on/off collar; and a depth locator mounted to the on/off collar and being rotatably and axially moveable relative to the on/off collar, the axial movement of the depth locator occurring in proportion to and in response to the relative rotation between the depth locator and the on/off collar, the depth locator establising a depth setting of the depth adjusting system, wherein the depth setting of the depth adjusting system can be adjusted by rotating the adjusting collar which in turn drives the depth locator to rotate in unison, such rotation causing axial movement of the depth locator; and wherein the on/off collar is removably attached to the base with a system comprising:

a plurality of resilient hinge portions formed at one end of the on/off collar;

each resilient hinge portion having a tab portion extending radially inwardly therefrom;

receiving means formed on the base for receiving the tab portions; and wherein the tabs portions are received in the receiving means and the resilient hinge portions are biased radially outwardly when the on/off collar is removably attached to the base.

3. The depth adjusting system of claim 2 wherein the tab portions are rounded and an axial pulling force alone can detach the on/off collar from the base.

* * * * *